US005554468A

United States Patent [19]

Datta et al.

[11] Patent Number: 5,554,468

[45] Date of Patent: Sep. 10, 1996

[54] CRT ELECTROPHOTOGRAPHIC SCREENING METHOD USING AN ORGANIC PHOTOCONDUCTIVE LAYER

[75] Inventors: Pabitra Datta, Cranbury; Eugene S. Poliniak, Willingboro, both of N.J.; Brian T. Collins, Lancaster, Pa.; Harry R. Stork, Adamstown, Pa.; Peter M. Ritt, East Petersburg, Pa.; Edward R. Garrity, Jr., Lancaster, Pa.; Richard LaPeruta, Jr., Lititz, Pa.; George M. Ehemann, Jr., Lancaster, Pa.

[73] Assignee: Thomson Consumer Electronics, Inc., Indianapolis, Ind.

[21] Appl. No.: 430,004

[22] Filed: Apr. 27, 1995

[51] Int. Cl.[6] ..... G03G 5/00; G03G 5/06

[52] U.S. Cl. ..... 430/28; 430/133

[58] Field of Search ..... 430/28, 133

[56] References Cited

U.S. PATENT DOCUMENTS

| | | | |
|---|---|---|---|
| 3,475,169 | 10/1969 | Lange . | |
| 3,489,556 | 1/1970 | Drozd . | |
| 3,558,310 | 1/1971 | Mayaud . | |
| 4,921,767 | 5/1990 | Datta et al. | 430/23 |
| 5,083,959 | 1/1992 | Datta et al. | 445/52 |
| 5,114,736 | 5/1992 | Griffiths et al. | 430/127 X |
| 5,229,234 | 7/1993 | Riddle et al. | 430/28 |
| 5,240,798 | 8/1993 | Ehemann, Jr. | 430/23 |
| 5,413,885 | 5/1995 | Datta et al. | 430/28 |
| 5,474,866 | 12/1995 | Ritt et al. | 430/23 |

*Primary Examiner*—Roland Martin

*Attorney, Agent, or Firm*—Joseph S. Tripoli; Dennis H. Irlbeck; Vincent J. Coughlin, Jr.

[57] ABSTRACT

In accordance with the present invention, a method of electro-photographically manufacturing a luminescent screen assembly on an interior surface of a faceplate panel 12 for a color CRT 10 includes the steps of coating the interior surface of the faceplate panel with a volatilizable, organic conductive solution to form an organic conductive (OC) layer 32, and overcoating the OC layer with a volatilizable, organic photoconductive solution to form an organic photoconductive (OPC) layer 34. The step of overcoating the OC layer to form the OPC layer is improved by the substeps of: grounding the OC layer; providing an organic photoconductive (OPC) solution comprising a resin, an electron donor material and electron acceptor material, and a suitable solvent; and spraying electrostatically-charged droplets of the OPC solution onto the OC layer, with at least one electrostatic spray gun 47, to provide an OPC layer, having uniform thickness, overlying the OC layer.

18 Claims, 3 Drawing Sheets

Fig. 1
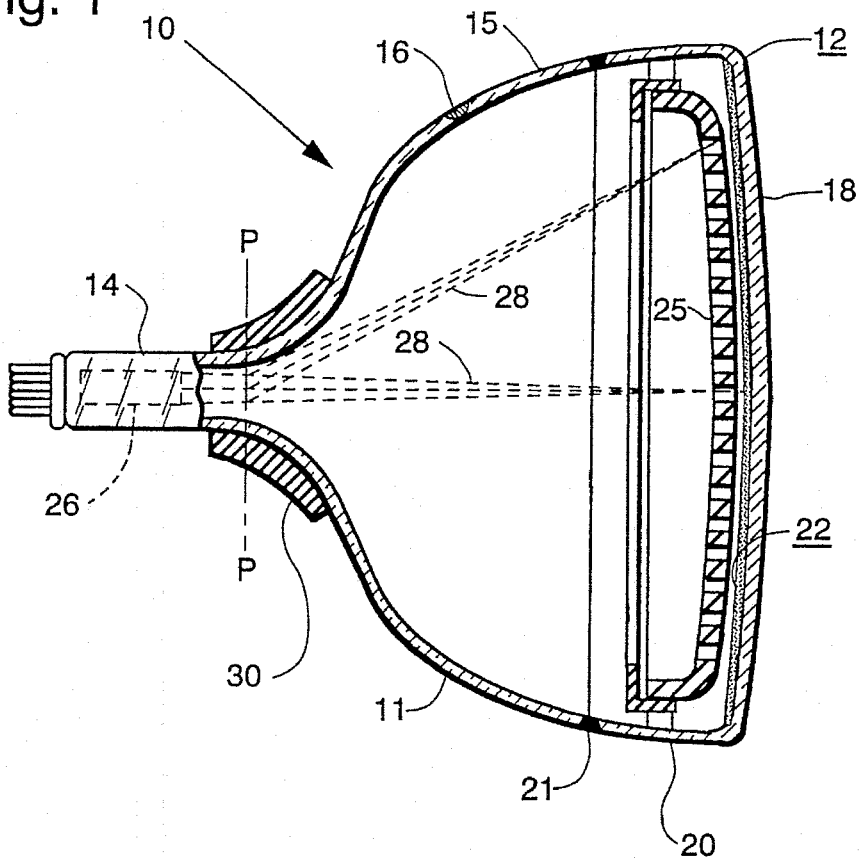
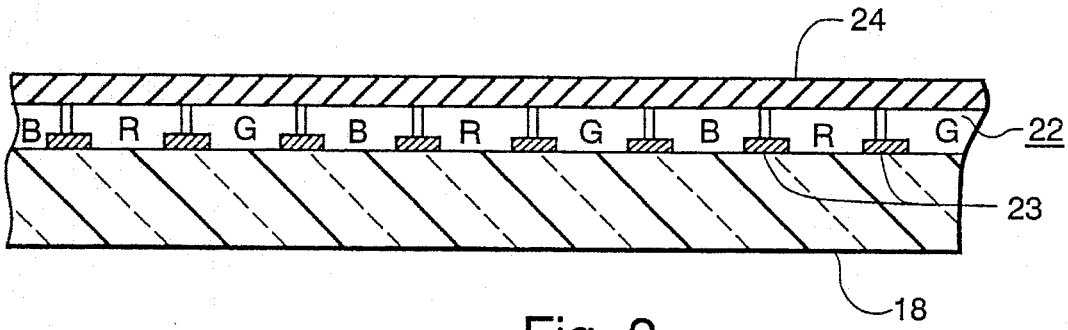
Fig. 2

CRT ELECTROPHOTOGRAPHIC SCREENING METHOD USING AN ORGANIC PHOTOCONDUCTIVE LAYER

This invention relates to a method of electrophotographically manufacturing a luminescent screen assembly for a cathode-ray tube (CRT) and, more particularly, to an improved method for depositing an organic photoconductive layer onto an interior surface of the CRT faceplate.

U.S. Pat. No. 4,921,767, issued to Datta et al., on May 1, 1990, describes the basic method of manufacturing a luminescent screen for a color CRT by the electrophotographic screening (EPS) process, using dry-powdered, triboelectrically-charged screen structure materials that are serially deposited onto a suitable photoreceptor disposed on an interior surface of a faceplate panel. The photoreceptor comprises, preferably, an organic conductive (OC) layer having a thickness of about 1 micron (μm) and an overlying organic photoconductive (OPC) layer having a thickness of about 5–6 μm.

The formulation of the OPC layer recently has been changed from that of the above-referenced patent, to reduce its spectral sensitivity beyond 550 nanometers (nm), so that the screen may be processed in yellow light, rather than in the dark, as required for the prior OPC material. In co-pending U.S. Pat. No. 5,413,885, issued on May 9, 1995 to Datta et al., an OPC layer formed from a solution of polystyrene resin; 2,4-DMPBT as an electron donor material; TNF and 2-EAQ as electron acceptor materials; a surfactant; and a suitable solvent, such as toluene or xylene, is described. The improved OPC layer may be deposited by spin-coating or air-spraying the above-described solution onto the interior surface of the faceplate panel. A drawback of spin coating is that various spin cycle speeds and orientations are required to obtain a substantially uniform coating. Also, the typical coating time for faceplate panel having a 51 cm diagonal dimension is about 90 seconds and about 90 % of the applied material is wasted. This process time is unacceptably long for a production environment in which an OPC application time of 8 seconds or less is desired. The material waste also increases the manufacturing cost of the CRT. A similar drawback is encountered when the OPC layer is air-sprayed onto the interior surface of the faceplate panel, using a conventional spraying apparatus. In addition, conventional air spraying requires a multiplicity of passes across the interior surface to deposit an OPC layer having a thickness of 5–6 μm, and large droplets of OPC material frequently are deposited onto the underlying OC layer, causing surface irregularities in the photoreceptor. These surface irregularities cause non-uniform electrostatic charging of the photoreceptor and corresponding non-uniformities in the luminescent screen. Accordingly, it is desirable to utilize a method of application that provides a substantially uniform OPC layer in about 8 seconds or less, with none of the aforementioned drawbacks.

SUMMARY OF THE INVENTION

In accordance with the present invention, a method of electro-photographically manufacturing a luminescent screen assembly on an interior surface of a faceplate panel for a color CRT includes the steps of coating the interior surface of the faceplate panel with a volatilizable, organic conductive solution to form an organic conductive (OC) layer, and overcoating the OC layer with a volatilizable, organic photoconductive solution to form an organic photoconductive (OPC) layer. The step of overcoating the OC layer to form the OPC layer is improved by the substeps of: grounding the OC layer; providing an organic photoconductive (OPC) solution comprising a resin, an electron donor material and electron acceptor material, and a suitable solvent; and electrostatically spraying charged droplets of the OPC solution onto the OC layer, with at least one electrostatic spray gun, to provide an OPC layer, having uniform thickness, overlying the OC layer.

BRIEF DESCRIPTION OF THE DRAWINGS

The invention will now be described in greater detail, with relation to the accompanying drawings, in which:

FIG. 1 is a plan view, partially in axial section, of a color CRT made according to the present invention;

FIG. 2 is a section of a faceplate panel of the CRT of FIG. 1, showing a screen assembly;

DETAILED DESCRIPTION OF THE PREFERRED EMBODIMENT

Figure 3:
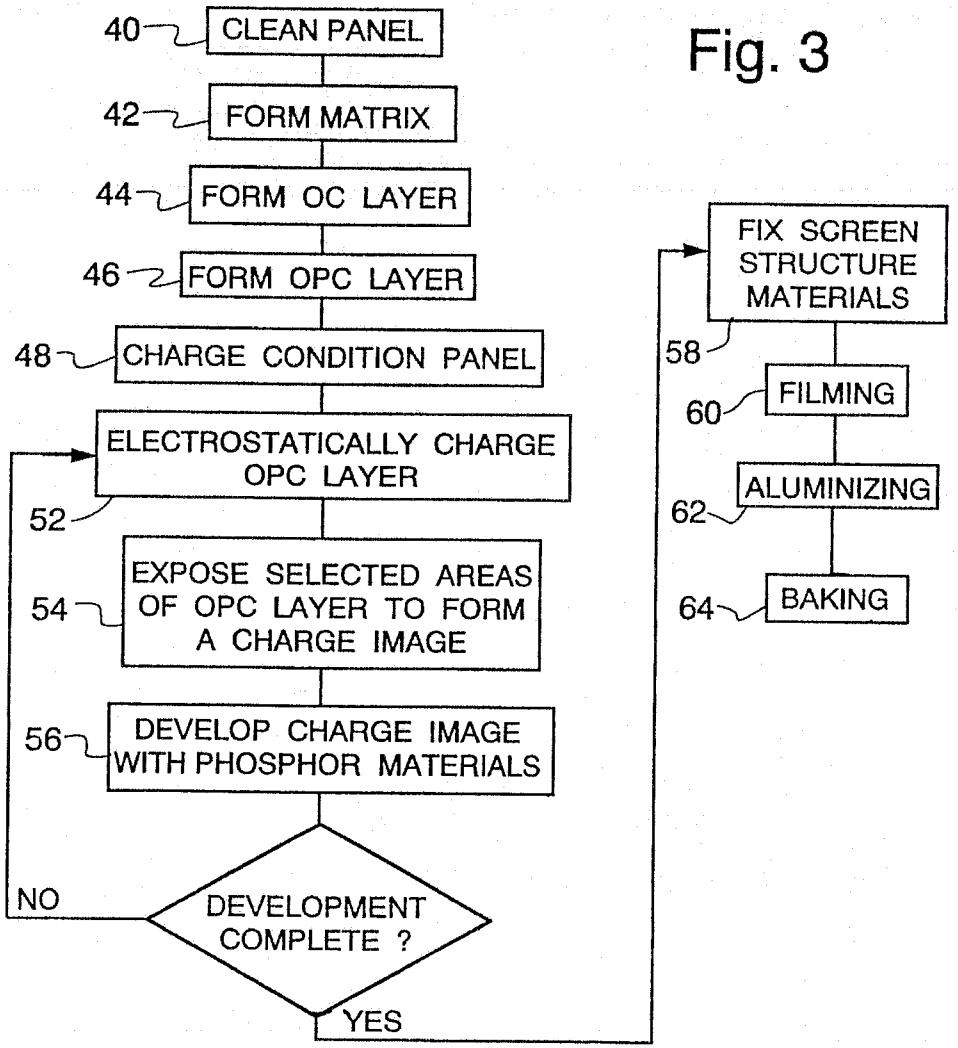
FIG. 3 is a block diagram comprising a flow chart of the manufacturing process involved.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass flit 21. A luminescent three color phosphor screen 22 is carried on the inner surface of the faceplate 18. The screen 22, shown in FIG. 2, is a line screen which includes a multiplicity of screen elements comprised of red-emitting, green-emitting and blue-emitting phosphor stripes R, G, and B, respectively, arranged in color groups or picture elements of three stripes or triads, in a cyclic order. The stripes extend in a direction which is generally normal to the plane in which the electron beams are generated. In the normal viewing position of the embodiment, the phosphor stripes extend in the vertical direction. Portions of the phosphor stripes overlap a relatively thin, light absorptive matrix 23, shown in FIG. 2, that is, preferably, of the type formed by the "wet" process, as described in U.S. Pat. No. 3,558,310, issued to Mayaud on Jan. 26, 1971, or, alternatively, of the type formed by the EPS process in either a single step, as described in the above-cited U.S. Pat. No. 4,921,767, or by the "two step" process described in U.S. Pat. No. 5,229,234, issued to Riddle et al., on Jul. 20, 1993. The "two step" matrix deposition process increases the opacity of the resultant matrix over that of the single step process, so that it has an opacity equivalent to that of the matrix formed by the "wet" process. Also in the alternative, the matrix can be formed by the EPS process after the screen elements are deposited, as described in U.S. Pat. No. 5,240,798, issued to Ehemann, Jr., on Aug. 31, 1993. A dot screen also may be formed by the novel process. A thin conductive layer 24, preferably of aluminum, overlies the screen 22 and provides means for applying a uniform potential to the screen, as well as for reflecting light, emitted from the phosphor elements, through the faceplate 18. The screen 22 and the overlying aluminum layer 24 comprise a screen assembly. A multi-apertured color selection electrode or shadow mask 25 is removably mounted, by conventional means, in predetermined spaced relation to the screen assembly.

An electron gun 26, shown schematically by the dashed lines in FIG. 1, is centrally mounted within the neck 14, to generate and direct three electron beams 28 along convergent paths, through the apertures in the mask 25, to the screen 22. The electron gun is conventional and may be any suitable gun known in the art.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the deflection zone, are not shown.

The screen 22 is manufactured by an electrophotographic screening (EPS) process that is shown schematically in FIG. 3. Initially, the panel 12 is cleaned, as indicated at reference numeral 40, by washing it with a caustic solution, rinsing it in water, etching it with buffered hydrofluoric acid and rinsing it again with water, as is known in the art. The interior surface of the viewing faceplate 18 is then provided with the light absorbing matrix 23, as indicated by reference numeral 42, preferably using the conventional wet matrix process described in the above-cited U.S. Pat. No. 3,558,310. In the wet matrix process, a suitable aqueous photoresist solution is applied to the interior surface of the panel 12, e.g., by spin coating, and the solution is dried to form a photoresist layer. Then, the shadow mask is inserted into the panel and the panel is placed onto a three-in-one lighthouse (not shown), that exposes the photoresist layer to actinic radiation from a light source which projects light through the openings in the shadow mask. The exposure is repeated two more times, with the light source located to simulate the paths of the electron beams from the three electron guns of the CRT. The light selectively alters the solubility of the exposed areas of the photoresist layer where phosphor materials subsequently will be deposited. After the third exposure, the panel is removed from the lighthouse and the shadow mask is removed from the panel. The photoresist layer is developed, using water, to remove the more soluble areas thereof, thereby exposing the underlying interior surface of the faceplate, and leaving the less soluble, exposed areas of the photoresist layer intact. A suitable solution of light-absorbing material (not shown) then is provided on the interior surface of the faceplate 18 and uniformly dispersed to cover the exposed portion of the faceplate and the retained, less soluble, areas of the photoresist layer on the panel 12. The layer of light-absorbing material is dried and developed, using a suitable solution which will dissolve and remove the retained portion of the photoresist layer and the overlying light-absorbing material, thereby forming windows in the matrix layer which is adhered to the interior surface of the faceplate. For a panel having a diagonal dimension of 51 cm, the window openings formed in the matrix have a width of about 0.13 to 0.18 mm, and the matrix lines have a width of about 0.1 to 0.15 mm.

The interior surface of the faceplate 18, having the matrix 23 thereon, is then uniformly coated with a suitable volatilizable, organic conductive material to form an organic conductive (OC) layer 32, as indicated by reference numeral 44, which provides an electrode for an overlying volatilizable, organic photoconductive (OPC) layer 34, described hereinafter. Suitable materials for the OC layer 32 include certain quaternary ammonium polyelectrolytes recited in U.S. Pat. Ser. No. 5,370,952, issued on Dec. 6, 1994 to Datta et al. Additionally, an IR absorbing dye, such as nigrosine, pligene blue, tetrabromophenol blue or aminium salts, may be added to the solution that forms the OC layer 32 to increase the IR absorption thereof. The 0C layer 32 has a thickness of about 1 μm, and is air dried.

Figure 4:
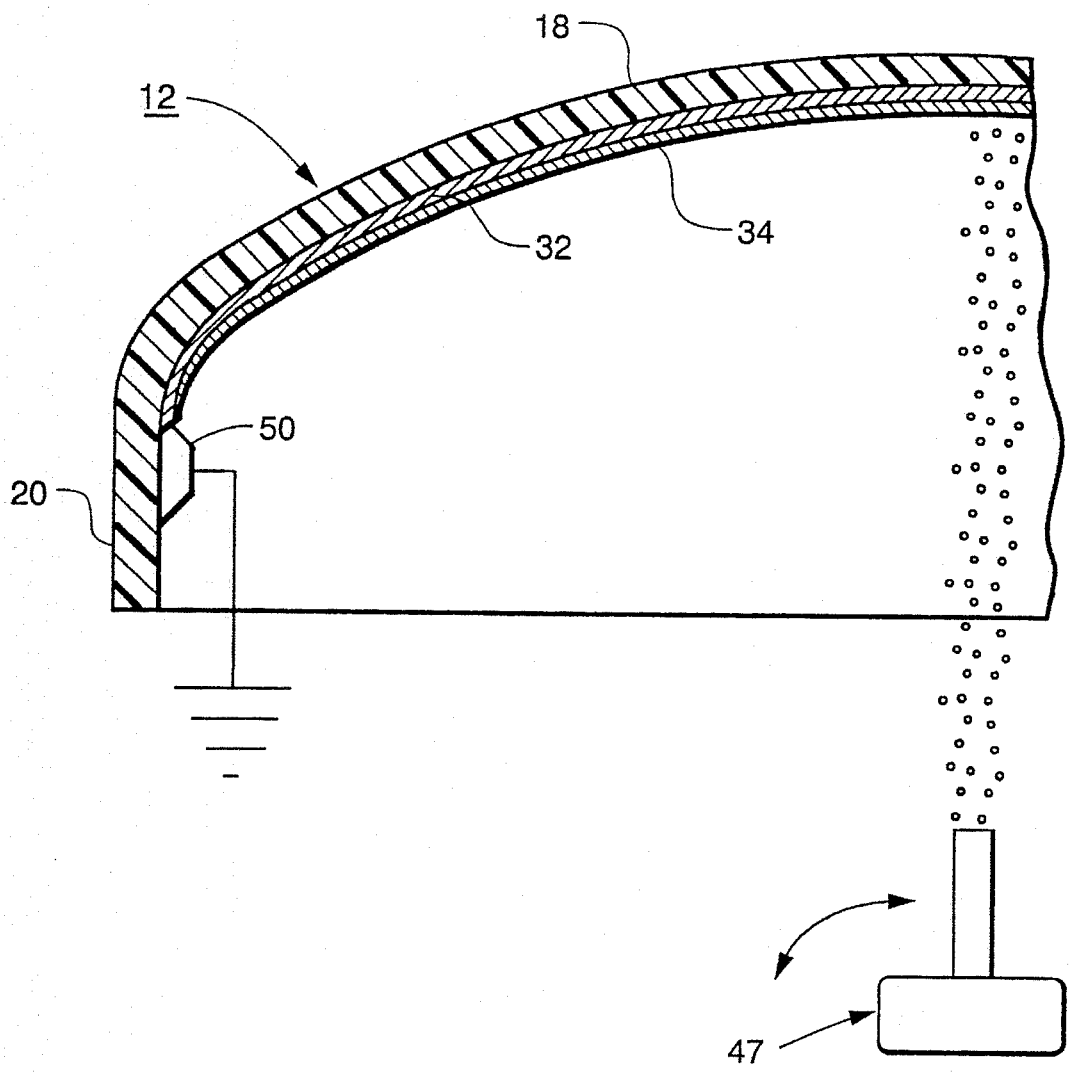
FIG. 4 schematically shows the electrostatic spraying of the OPC solution onto an OC layer on a section of a faceplate panel, to form the OPC layer.

The novel OPC layer 34 is formed, as indicated by reference numeral 46, by overcoating the dried OC layer 32 with an OPC solution containing polystyrene resin; an electron donor material, such as 1,4-di(2,4-methyl phenyl)-1,4diphenylbutatriene (2,4-DMPBT); electron acceptor materials, such as 2,4,7- trinitro-9- fluorenone (TNF) and 2-ethylanthroquinone (2- EAQ); a surfactant, such as silicone U-7602; and a mixture of solvents, preferably toluene and xylene. A plasticizer, such as dioctyl phthalate, also may be added to the solution. The surfactant U-7602 is available from Union Carbide, Danbury, Conn. The OPC solution is applied by means of at least one AEROBELL™ electrostatic spray gun. Two electrostatic spray guns 47 are satisfactory for spraying the OPC solution onto a 51 cm panel within the desired 8 second or less application time; however, three such guns are required for panels having a dimension within the range of 89 to 91 cm. The preferred AEROBELL™ model electrostatic spray gun is available from ITW Ransburg, Toledo, Ohio. The electrostatic gun provides negatively charged droplets of OPC solution of uniform size which are spray-deposited onto the OC layer 32. As shown in FIG. 4 the panel 12 is oriented with the OC layer 32 directed downwardly, toward the electrostatic gun 47. The downward orientation of the panel 12 prevents any large droplets forming on the gun from dropping onto the OC layer 32 and causing surface irregularities in the photoreceptor. The OC layer 32 is grounded by means of a metal stud 50 during the electrostatic spraying operation so that the negatively charged droplets of the OPC solution are attracted to the more electrically positive OC layer 32. The operating parameters for each of the two AEROBELL™ spray guns (only one of which is shown in FIG. 4), sweeping across the inner surface of the faceplate 18, at a fixed distance of about 14 cm from the seal edge of the panel 12 are as follows: air turbine speed 30,000 rpm; spray gun voltage 70–80 kV; gun fluid (gauge) pressure, about 1.05 kg $cm^{-2}$; and spray-shaping air pressure, about 0.7 kg $cm^{-2}$. Under these electrostatic spraying conditions, 40 to 50 ml of OPC solution is dispensed from the guns 47. The composition of the present OPC solution consists essentially of between 4.8 to 7.2 wt. % of polystyrene resin; between 0.8 to 1.2 wt. % of 2,4-DMPBT, as the electron donor material; about 0.04 to 0.06 wt. % of TNF and about 0.12 to 0.36 wt. % of 2-EAQ, as electron acceptor materials; about 0.3 wt. % of DOP, as a plasticizer; 0.01 wt. % of silicone U-7602, as a surfactant; and the balance comprising a mixture of a low and a high boiling point solvent, such as toluene and xylene, having boiling points of 111° C. and 144° C., respectively. The high boiling point solvent is defined as a solvent having a boiling point greater than the boiling point of toluene. The toluene concentration in the OPC solution is within the range of 18 to 75 wt. % and the xylene concentration is within the range of 75 to 18 wt. %. If the xylene concentration exceeds this range, the OPC solution will be too wet and will sag, or run, on the panel during drying. The total solid content of the present OPC solution ranges from 6 to 9 wt. %, but a solid content within the range of 7 to 8 wt. % is preferred. In a preferred solution currently undergoing extensive evaluation, the concentration of solids is about 7 wt. %, toluene is about 23 wt. % and xylene is about 70 wt.

%. In general, as the concentration of solids, such as the resin, and the electron donor and acceptor materials, in the solution increases, the concentration of xylene in the solution also should increase, within the above described limits. However, in order to keep the OPC layer thickness within the range of 5 to 6 μm, the other spray parameters, such as spray fluid pressure must be decreased so that the amount of spray reaching the panel surface is decreased.

The OPC solution of the present invention differs from the OPC solution described in co-pending U.S. Pat. No. 5,413,885, reference above, in that the present OPC solution has a lower concentration of solid constituents than the preferred solution of the patent. Additionally, the solution described in the 168,486 application utilizes only a single solvent, whereas a mixture of solvents is required for the electrostatic spray application of the present OPC solution. If only toluene were used in the present OPC solution, as was the case in nine of ten examples in the prior U.S. Pat. No. 5,413,885, the electrostatically sprayed OPC solution would not be wet enough, and the resultant OPC layer would be mottled and non-uniform, thus adversely affecting the appearance of the luminescent screen. However, if only xylene were used, as in the tenth example of the prior patent application, then the OPC solution would be too wet and would run or tend to sag so that the resultant OPC layer also would be non-uniform, thus deleteriously affecting the appearance of the luminescent screen. Thus, in the present OPC solution a mixture of toluene and xylene, within the limits set forth above, is required. However, if not enough of the higher boiling point xylene is present in the OPC solution for the spray conditions that are employed, defects in the screen also will occur. The wetness of the OPC electrostatic spray application is critical and can be affected through various methods. The preferred method, for example, is to increase the concentration of xylene in the OPC spray solution within the limits described herein. However, other techniques, such as prewetting the surface of the OC layer 32 with a spray of a high boiling point solvent, such as xylene, prior to OPC spray application, or generating a vapor pressure of a high boiling point solvent, such as xylene, near the surface of the OC layer prior to OPC spray application also are useful. It is believed that the homogeneity of the resultant OPC layer 34, both physically and chemically, is improved with a wetter spray application. It also is believed that localized charge trapping centers develop in an insufficiently wet OPC layer and result in subsequent phosphor defects. As the xylene content of the OPC spray is increased, the drying time or the drying temperature of the OPC layer 34, during charge conditioning, also is increased because of the increased concentration of the higher boiling point solvent. Therefore, a balance between the wetness of the applied OPC layer and charge conditioning process time must be maintained.

In the example described in the U.S. Pat. No. 5,413,885, in which both TNF and 2-EAQ where used as the electron acceptor materials, the solution contained the following ingredients: 10 wt. % of polystyrene resin; 1.66 wt. % of the electron donor material 2,4-DMPBT; 0.083 wt. % of TNF and 0.25 wt. % of 2- EAQ, the electron acceptor materials; 0.005 wt. % silicone U-7602; and the balance toluene. The relatively high concentration of solid constituents in the prior OPC solution is too great to permit the solution of form a smooth OPC layer of uniform thickness, unless it is applied by spin coating.

The OPC layer 34 is then charge-conditioned, as indicated by reference numeral 48, to remove excess moisture, including trapped solvents, in order that the OPC layer 34 will adequately accept and retain an electrostatic charge. Charge-conditioning includes the steps (not shown) of preheating, drying and cooling the OPC layer 34. As indicated by reference numeral 52 in FIG. 3, the OPC layer 34 then is uniformly electrostatically charged using a corona discharge device of the type described in U.S. Pat. No. 5,083,959, issued to Datta et al., on Jan. 28, 1992, which charges the OPC layer 34 to a voltage within the range of approximately +200 to +700 volts.

The shadow mask 25 is then inserted into the panel 12, which is placed onto a lighthouse exposure device, as indicated by reference numeral 54, and the positively charged OPC layer 34 is exposed, through the shadow mask 25, to light from a xenon flash lamp or other light source of sufficient intensity, such as a mercury arc, disposed within the exposure device. The light which passes through the apertures in the shadow mask 25, at angles identical to those of one of the electron beams from the electron gun of the tube, discharges the illuminated areas on the OPC layer 34 on which it is incident and forms a charge image. The shadow mask is removed from the panel 12, and the panel is placed onto a first phosphor developer, as indicated by reference numeral 56. A first color-emitting phosphor material is positively triboelectrically-charged within the developer and directed toward the OPC layer 34. The positively-charged first color-emitting phosphor material is repelled by the positively-charged areas on the OPC layer 34 and deposited onto the discharged areas of the charge image by a process known in the art as "reversal" development. In reversal development, triboelectrically-charged particles of screen structure material are repelled by similarly charged areas of the OPC layer 34 and deposited onto the discharged areas thereof. The size of each of the lines of the first coloremitting phosphor is slightly larger than the size of the openings in the lightabsorbing matrix, to provide complete coverage of each opening and a slight overlap of the light-absorbing matrix material surrounding the openings. The OPC layer 34, with the phosphor thereon, is then recharged, light exposed, and phosphor developed, as indicated by reference numerals 52, 54 and 56, respectively, for each of the two remaining color-emitting phosphors. The size of each of the lines of the other two color-emitting phosphors on the OPC layer 34 also is larger than the size of the matrix openings, to ensure that no gaps occur and that a slight overlap of the light-absorbing matrix material surrounding the openings is provided.

The screen 22 is then fixed, as indicated by reference numeral 58, to the above-described OPC layer 34, by contacting the phosphors with a suitable fixative, to secure the phosphors to the OPC layer. Next, the screen 22 is filmed, as indicated by reference numeral 60, to provide a smooth surface onto which the aluminum layer 24 is deposited during the aluminizing step, indicated by reference numeral 62. After aluminizing, the screen is baked, as indicated by reference numeral 64, at a temperature of about 425° C., for about 30 minutes, to drive off the volatilizable constituents of the screen assembly.

What is claim is:

1. In a method of manufacturing a luminescent screen assembly for a CRT on an interior surface of a viewing faceplate of a panel comprising the steps of:

a) coating said interior surface of said viewing faceplate to form a volatilizable organic conductive (OC) layer;

b) overcoating said OC layer to form a volatilizable organic photoconductive (OPC) layer;

c) electrostatically charging said OPC layer;

d) exposing selected areas of said OPC layer light to form a charge image; and e) developing said charge image with at least one phosphor material; the improvement wherein step b) includes the sub-steps of:

i) grounding said OC layer;

ii) providing an organic photoconductive solution comprising a resin, an electron donor material, an electron acceptor material and a mixture of two solvents having different boiling points; and iii) spraying electrostatically-charged droplets of said organic photoconductive solution onto said OC layer, with at least one electrostatic spray gun, to provide said OPC layer, having uniform thickness, overlying said OC layer.

2. The method as described in claim 1, where the solid content of said solution is within the range of 6 to 9 wt. %.

3. The method as described in claim 1, where the solid content of said solution is within the range of 7 to 8 wt. %.

4. The method as described in claim 1, wherein said mixture of two solvents includes a first solvent having a low boiling point of about 111° C. and a second solvent having a high boiling point greater than about 111° C.

5. The method as described in claim 4, wherein said low boiling point solvent comprises toluene and said high boiling point solvent comprises xylene.

6. The method as described in claim 1, wherein said organic photoconductive solution consists essentially of:

about 4.8 to 7.2 wt. % of a polystyrene resin;

about 0.8 to 1.2 wt. % of 2,4-DMPBT, as the electron donor material;

about 0.16 to 0.42 wt. % of TNF and EAQ, as electron acceptor materials; the balance a mixture of toluene and xylene.

7. The method as described in claim 6, wherein said toluene in the balance of said solution is within the range of 18 to 75 wt. % and said xylene is within the range of 75 to 18 wt. %.

8. The method as described in claim 6, further including about 0.3 wt. % of DOP, as a plasticizer, and 0.01 wt. % of silicone U-7602, as a surfactant.

9. The method as described in claim 1, wherein prior to step b) said OC layer is exposed to a high boiling point solvent either by prewetting the surface of said 0C layer or by generating a vapor pressure near the surface by using a high boiling point solvent.

10. The method as described in claim 9, wherein said high boiling point solvent is xylene.

11. In a method of manufacturing a luminescent screen assembly for a color CRT on an interior surface of a viewing faceplate of a panel comprising the steps of;

a) coating said interior surface of said viewing faceplate to form a volatilizable organic conductive (OC) layer; and b) overcoating said OC layer to form a volatilizable organic photoconductive (OPC) layer having substantially no spectral sensitivity beyond 550 nm;

c) electrostatically charging said OPC layer;

d) exposing selected areas of said OPC layer to light to form a charge image;

e) developing said charge image with a triboelectrically charged, dry-powdered, first color emitting phosphor;

f) sequentially repeating steps c, d, and e for triboelectrically charged, dry-powdered, second and third color-emitting phosphors to form a luminescent screen comprising picture elements of triads of color-emitting phosphors;

g) fixing said phosphor materials to said OPC layer;

h) filming said phosphor materials;

i) depositing an aluminum layer thereon to form said screen assembly; and j) baking said screen assembly at an elevated temperature to drive off the volatilizable constituents thereof; the improvement wherein step b) includes the sub-steps of:

k) grounding said OC layer;

l) providing an organic photoconductive solution comprising at least a resin, an electron donor material, an electron acceptor material and a mixture of suitable solvents having different boiling points; and m) spraying electrostatically-charged droplets of said organic photoconductive solution onto said OC layer, with at least one electrostatic spray gun, to provide said OPC layer, having uniform thickness, overlying said OC layer.

12. The method as described in claim 11, wherein said organic photoconductive solution consists essentially of:

about 4.8 to 7.2 wt. % of a polystyrene resin;

about 0.8 to 1.2 wt. % of 2,4-DMPBT, as the electron donor material;

about 0.16 to 0.42 wt. % of TNF and EAQ, as electron acceptor materials;

the balance a mixture of a first solvent and a second solvent.

13. The method as described in claim 12, wherein said first solvent in the balance of said solution is within the range of 18 to 75 wt. % and said second solvent is within the range of 75 to 18 wt. %.

14. The method as described in claim 12, further including about 0.3 wt. % of DOP, as a plasticizer, and 0.01 wt. % of silicone U-7602, as a surfactant.

15. The method as described in claim 11, wherein prior to step b) said 0C layer is exposed to a high boiling point solvent either by prewetting the surface of said OC layer or by generating a vapor pressure near the surface by using a high boiling point solvent.

16. The method as described in claim 15, wherein said high boiling point solvent is xylene.

17. The method as described in claim 1, further including, after step e), the additional steps of:

f) fixing said phosphor material to said OPC layer;

g) filming said phosphor material;

h) depositing an aluminum layer thereon to form said screen assembly; and i) baking said screen assembly at an elevated temperature to drive off the volatilizable constituents thereof.

18. The method as described in claim 12, wherein said first solvent is toluene, having a boiling point of 111° C., and said second solvent is xylene, having a boiling point of 144° C.

* * * * *